United States Patent [19]

Krenzler

[11] 4,022,143

[45] May 10, 1977

[54] WIDE-KEELED BOAT HULL WITH MULTIPLE, STRAIGHT LINE PLANING SURFACES

[76] Inventor: Leo M. Krenzler, 2556 E. 11th St., Tacoma, Wash. 98421

[22] Filed: Sept. 24, 1975

[21] Appl. No.: 616,488

[52] U.S. Cl. ..... 114/271; 114/56

[51] Int. Cl.[2] ..... B63B 1/18

[58] Field of Search ..... 114/56, 66.5 R, 66.5 S, 114/140; 9/6 M, 6 P; D12/62

[56] References Cited

UNITED STATES PATENTS

| | | | |
|---|---|---|---|
| 3,040,687 | 6/1962 | Huet | 114/56 |
| 3,363,598 | 1/1968 | Mortrude | 114/56 X |
| 3,415,213 | 12/1968 | Nemetz | 114/56 |
| D230,258 | 2/1974 | Allison | D12/62 |

*Primary Examiner*—Trygve M. Blix
*Assistant Examiner*—Gregory W. O'Connor
*Attorney, Agent, or Firm*—Eugene D. Farley

[57] ABSTRACT

A high speed planing boat hull including a transom stern, freeboard side portions and a wide-keeled lower hull portion which comprises keel sidewalls forming steep relatively constant deadrise angles, and keel bottom surfaces which are flat at the transom and progress forwardly to form shallow deadrise angles. First steps having shallow deadrise angles are located adjacent the keel sidewalls, second steps having similar deadrise angles are located adjacent the side portions, and risers having steep deadrise angles interconnect the first and second steps.

4 Claims, 6 Drawing Figures

WIDE-KEELED BOAT HULL WITH MULTIPLE, STRAIGHT LINE PLANING SURFACES

BACKGROUND OF THE INVENTION

This invention relates in general to a boat hull and in particular to a boat hull configured for high speed planing operation.

Prior art boat hulls for use in high speed motor powered operation generally have been of two classes. The original planing hulls were flat bottomed since this shape gives minimum resistance and thus maximum hydrodynamic efficiency in the planing mode.

Flat bottom boat hulls have several disadvantages, however. In general they are unseaworthy, being quite unstable at low speeds, when turning, or in rough water since a flat bottom hull presents a different profile depending on the position of the hull in the water. In addition, flat hulls pound or slap during high speed operation even in relatively calm waters. The latter characteristic makes for an uncomfortable ride and over a period of time causes damage to the boat.

The second class of boat hulls is the deep V hulls. They comprise hulls having step deadrise angles (deadrise angle is the angle which the bottom surfaces make with the horizontal), and chines positioned considerably above the at rest water line of the hull (chine is the juncture of the bottom surfaces and the sides). Deep V-hulls eliminate most of the seaworthiness problems associated with flat bottom hulls.

The major disadvantage of the deep V-hull is that the increased planing surface area inherent in the design greatly increases water friction. Thus larger and more powerful engines are necessary to bring the hull to a given speed.

In addition the deep V-hulls ride at a high bow-up attitude, particularly when accelerating and decelerating. Thus operator visibility is obscured by the bow, creating unsafe navigational conditions. Furthermore, they do not maintain a positive planing angle when in operation resulting in low lateral stability.

Also due to the high bow-up attitude and fast sink rate they are subject to swamping by backwash when rapidly decelerated.

Accordingly, it is the general purpose of the present invention to provide a boat hull for high speed planing operation which combines hydrodynamic efficiency and seaworthiness.

It is a further purpose of the present invention to provide such a boat hull that will plane at low speeds allowing use of lower powered engines, resulting in the saving of fuel.

It is a further purpose of the present invention to provide such a boat hull that planes at a small positive planing angle to provide good handling characteristics without pounding or slapping.

It is a further purpose of the present invention to provide such a boat hull wherein the planing angle remains nearly constant during acceleration and deceleration to increase operator visibility and to lessen the hazard of backwash.

It is a further purpose of the present invention to provide such a boat hull having outer chines positioned out of the water during high speed planing operation to prevent lunging of the hull in turns and to increase lateral stability.

It is a further purpose of the present invention to provide such a boat hull having reserve planing surfaces to maintain controlled lateral stability while turning.

It is a further purpose of the present invention to provide such a boat hull wherein the engine may be mounted in the keel at a location low in the hull minimizing propeller cavitation as well as providing increased stability at rest, during high speed planing and while turning. THE DRAWINGS The manner in which the foregoing and other objects of the invention are accomplished will be apparent from the accompanying specification and claims, considered together with the drawings wherein:

Figure 1:
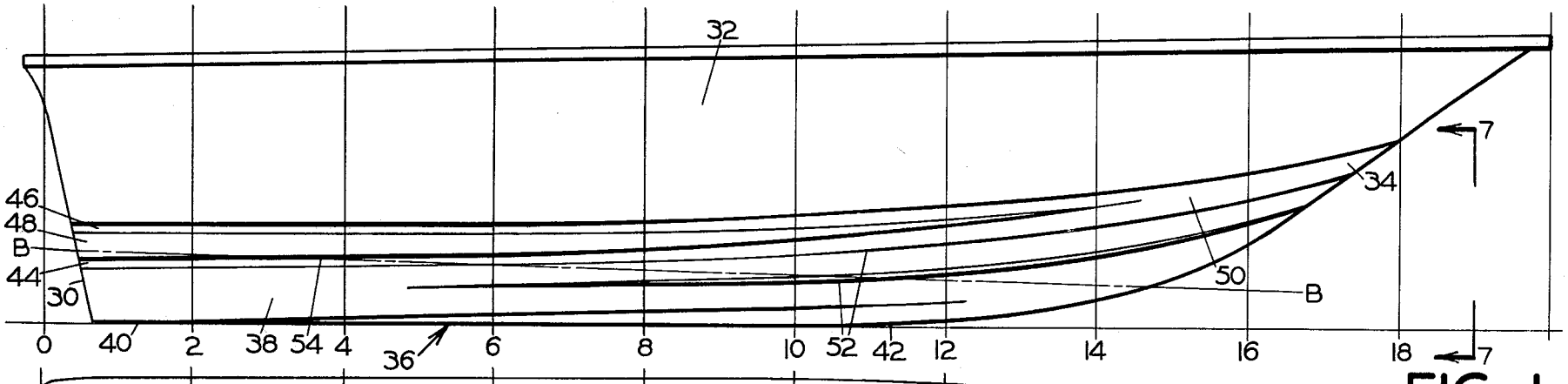
FIG. 1 is a side elevation view of the boat hull described herein.
Figure 7:
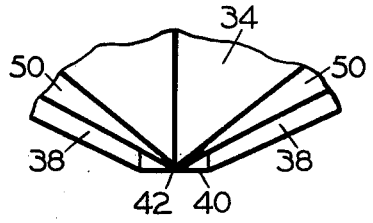
Figure 4:
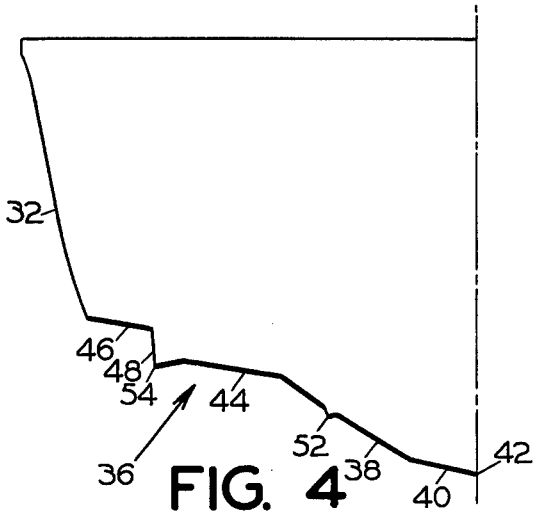
Figure 5:
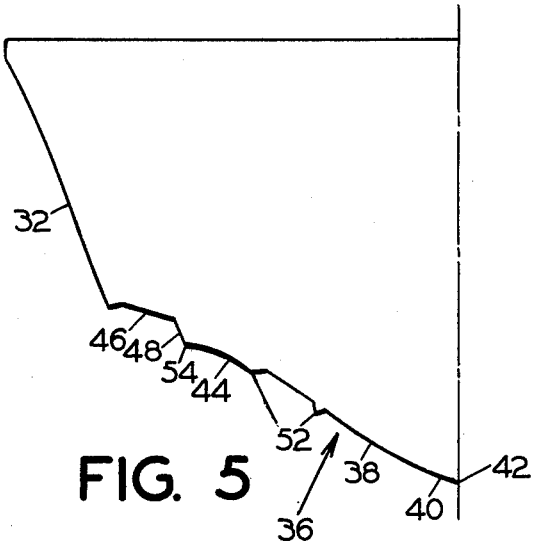
Figure 6:
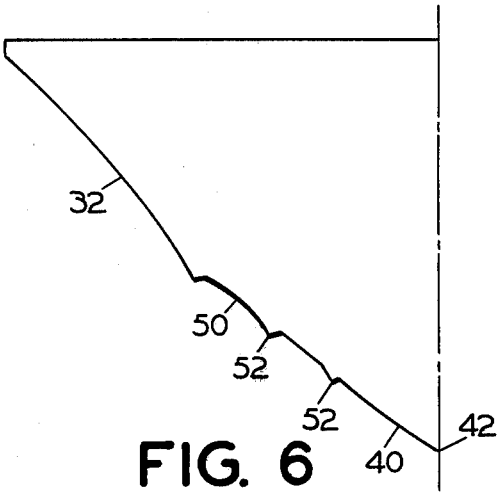

FIGS. 4–6 are diagrammatic, one-half sectional views taken at stations 6, 10 and 14 respectively as indicated on FIG. 1; and FIG. 7 is a fragmentary front elevation view taken along the line 7—7 of FIG. 1.

GENERAL STATEMENT OF THE INVENTION

The boat hull of the present invention generally comprises a wide keeled lower hull portion for high speed planing operation having keel sidewalls which form steep, relatively constant deadrise angles and keel bottom surfaces which are flat at the transom but progress forwardly to form increasing deadrise angles.

The hull comprises a transom stern and freeboard side portions which extend from the transom and terminate in a V-bow. The bottom keel surfaces merge into the bow ahead of the point at which the planing water line intersects the hull.

DETAILED DESCRIPTION OF A PREFERRED EMBODIMENT

Referring to the drawings, the boat hull of the present invention generally comprises a transom stern 30, side portions 32 extending forwardly from the transom stern and terminating in a V-bow 34, and a wide keeled lower hull portion 36 joining the side portions.

The boat hull is of the pleasure craft or commercial type providing motor-powered high speed planing operation. The boat hull is suited for use especially in conjunction with stern drive, inboard-outboard power means (not shown). It also can be powered by outboard engines or conventional inboard engines.

The wide keeled lower hull portion 36 comprises keel sidewalls 28 forming steep deadrise angles. For optimum performance the deadrise angles of the keel sidewalls should be between 20° and 45° . Preferably the angles should be more narrowly limited to the 25° to 35° range. The keel sidewalls form nearly constant angles over the major portion of the hull (from the transom up to approximately station 14 of FIG. 1).

The deadrise angles of the keel sidewalls gradually become steeper at the front portion of the hull finally flaring outwardly at the bow to merge with the side portions of the hull to provide desirable entrance and buoyancy characteristics. The flared portions, however, are above the planing water line.

Keel bottom surfaces 40 extend from joinder at the keel centerline 42 to meet the sides of the keel sidewalls. Depending on displacement and planing surface requirements the keel bottom surfaces preferably extend laterally approximately 10–25% of the total width of the lower hull portion. The keel bottom surfaces are flat and substantially horizontal at the transom, FIG. 3, and gradually progress in deadrise angle (FIGS. 4–6) to merge with the keel sidewalls at the forward end of the hull. Those portions of the keel bottom surface below the planing water line (B—B of FIG. 1) are maintained at shallow deadrise angles. At the bow of the hull, however, the keel bottom surfaces substantially blend with side portions 32 to form steep deadrise angles, FIG. 5 and 6. This results in a substantially flat longitudinal keel surface over approximately the rear 20% of the hull.

First steps 44 extend substantially the entire length of the hull in a plane substantially parallel to the horizontal plane of the keel centerline. The first steps extend outwardly at shallow deadrise angles from junctures with the keel sidewalls. Preferably, they form deadrise angles of 5°–10°. The angles of the first steps become steeper and the first steps become concave near the bow, FIG. 5. The first steps define a projected area that is approximately equal to that of the keel sidewalls.

Second steps 46 also extend substantially the entire length of the hull, again in a plane substantially parallel to the horizontal plane of the keel centerline. The second steps extend inwardly from the outer chines. Preferably they also form deadrise angles of 5°–10°. The second steps define a projected area equal to approximately one-half that of the first steps.

Risers 48 interconnect the first steps and the second steps to locate the first steps below the outer chines. The risers are preferably approximately 3–6 inches in height and form deadrise angles which are greater than those of the keel sidewalls. Thus inner chines are located at the juncture of the first steps and the risers.

At the bow, FIG. 6, the first steps, the second steps and the risers merge to form single concave steps 50 which are parallel to the lower surfaces.

Figure 3:
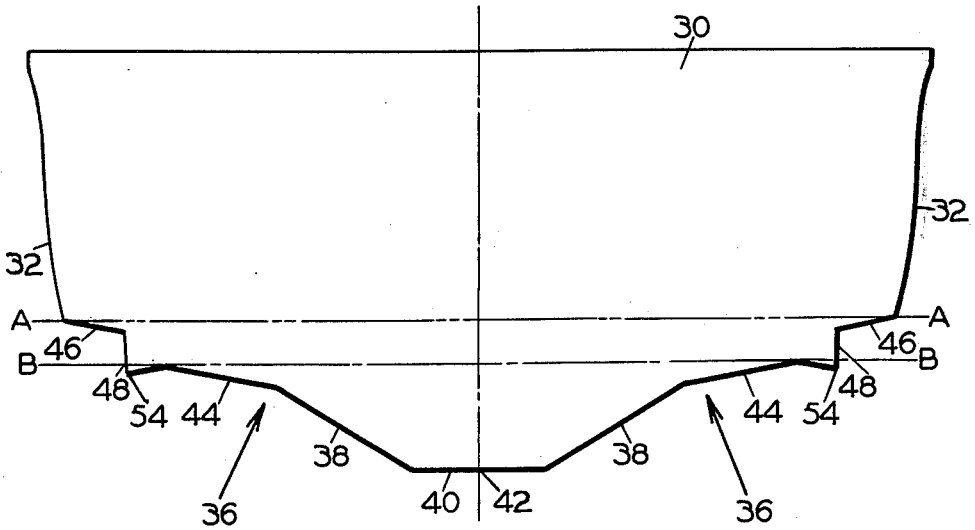
FIG. 3 is a rear elevation as viewed from the left of FIG. 1.

At the transom the outer chine junctures of the second steps and the side portions are located substantially at the at rest water line (A—A), and the inner chine junctures of the first steps and the risers are located substantially at the planing water line (B—B), FIG. 3. The exact physical location of these junctures will vary for boat hulls having different weights and utilizing different engines. However, the location of the junctures relative the respective water lines should be as indicated.

Spray strips 52 are located forwardly on the lower hull portion to force the water rearwardly onto the first steps during high speed planing operation of the boat. The spray strips comprise triangular protrusions which extend from the bow rearwardly to a point slightly above where the planing water line intersects the boat hull. In the embodiment illustrated two such spray strips are utilized.

Retention strips 54 are located at the inner chine junctures of the first steps and the risers to keep the water on the first steps during high speed planing operation of the boat. The retention strips comprise short, slightly downwardly angled steps which extend approximately one-half the longitudinal extent of the boat hull.

OPERATION

The operation of the herein described boat hull is as follows:

When a boat employing the hull of the present invention is at rest in the water, the at rest water line, shown by line A—A in FIG. 3, intersects the transom at the outer chine junctures. Normally the boat will be loaded so that it is approximately horizontal in the water when at rest.

During acceleration the increased low dead rise planing area of the first and second step, the flat keel bottom surfaces, and the displacement provided by the keel section cause the boat to plane at lower speeds and at a lesser planing angle than prior hulls.

When the hull is operated in the high speed planing mode the planing water line, shown by the line B-B in FIG. 3, intersects the transom at the inner chine junctures of the first steps and the risers. The greater lifting ability of the first step 44 FIG. 1 than that of the keel section 38 and 40, FIG. 1 allow the boat to maintain a low constant positive planing angle. Preferably the planing angle should be about 5° to give optimum handling characteristics and minimize pounding and slapping. Also the shallow planing angle keeps the bow low and the entry is always working to minimize pounding and to provide sea-worthiness in rough seas.

It will be noted that when the hull is in the high speed planing mode the rear portions of the keel section remain in the water to provide a relatively low constant positive planing angle at variable speeds. The hull's principal planing function is accomplished by the first step with some assistance from the keel section.

The increased lateral stability is particularly noted when the hull is turned, while pulling a water skier. The wide keel section which remains in the water during high speed planing prevents side forces at the transom created by the skier from causing sideslip of the hull. It also minimizes cavitation of the propeller.

Figure 2:
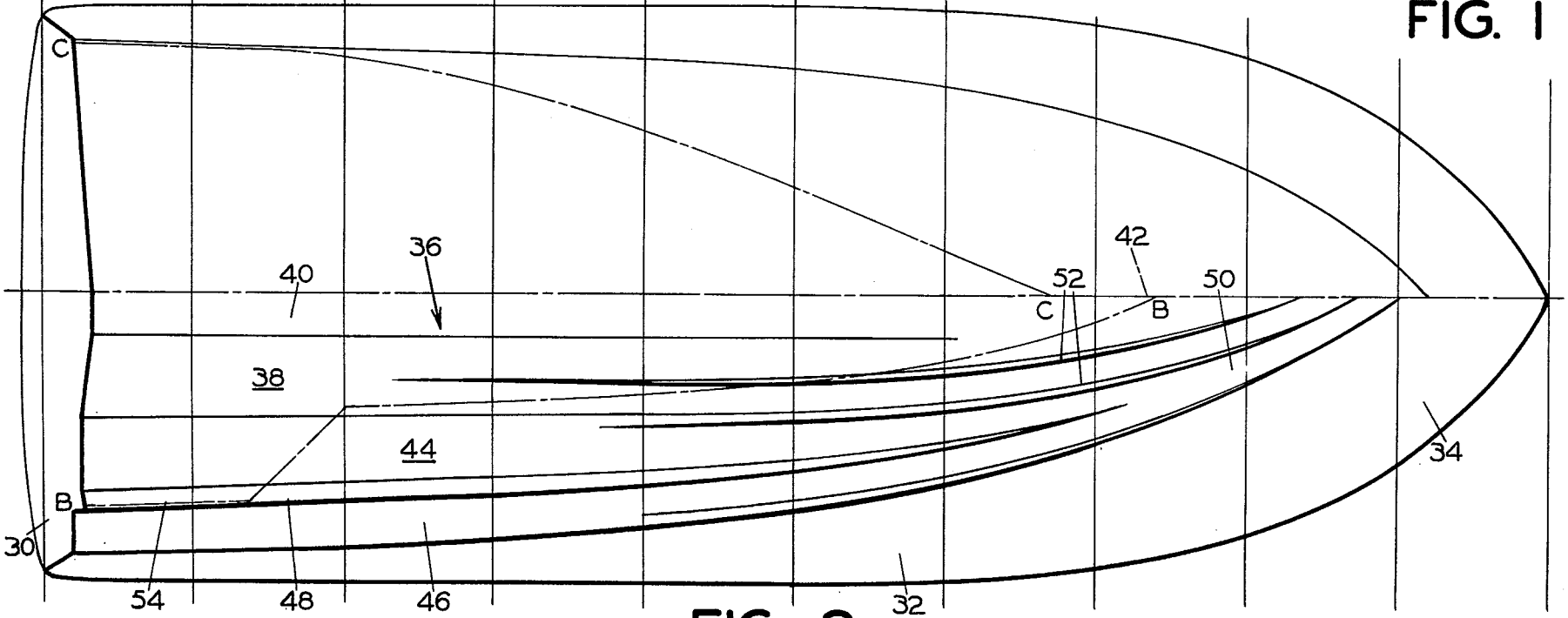
FIG. 2 is an inverse plan view showing the boat hull described herein on the bottom and a conventional deep V boat hull on the top.

When operating in the high speed planing mode the second steps are raised out of the water due to the height of the risers. Thus as will be noted in FIG. 2 which shows the hull of the present invention on the bottom and a conventional hull on the top, the hull of the present invention has a narrow wetted surface line, line B—B, due to the wide keel section. The prior hull has a much wider wetted surface line, line C—C, and will create more drag. In addition the outer chines are not subject to constant wave action.

When the boat is turned the second steps again contact the water to provide a reserve planing surface keeping the boat stable. This is particularly advantageous when steering control is lost causing the helm to go hard over at high speeds. In addition when the boat is decelerated the first and second steps provide a larger planing area so that the boat sinks into the water at a nearly constant planing angle. Thus no following wave is formed to wash over the transom as in prior planing hulls.

The spray strips serve to keep the water from washing up the bow and off of the first steps. They force the water rearwardly onto the first steps and end slightly above the planing water line.

The retention strips serve to keep the water on the first steps when the boat is operating in the high speed planing mode. Without the upper steps the water would be forced sideways out from under the first steps, thereby reducing their lifting efficiency.

It is to be noted that the deep, wide keel portion at the stern allows mounting the engine at a point low in the hull. This is advantageous for stern drive inboard-outboard power means as it creates a low center of gravity giving increased stability in heavy seas and prevents wind-induced drift when at rest.

Having thus described my invention in a preferred embodiment, I claim:

1. A high speed planing boat hull including a transom stern, freeboard side portions extending from the transom and terminating in a V-bow, a keel centerline extending the longitudinal extent of the hull and having a wide keeled lower hull portion extending from the keel centerline to outer chine junctures with the side portions, the wide keeled lower hull portion comprising a. keel sidewalls forming deadrise angles between 25° and 35°, b. keel bottom surfaces which are flat at the transom but progress forwardly to form increasing deadrise angles and to merge into the keel sidewalls slightly above the point at which the planing water line intersects the hull, c. first steps adjacent the keel bottom surfaces, substantially parallel to the horizontal plane of the keel centerline and having deadrise angles between 5° and 10°, d. risers extending at steep deadrise angles from inner chine junctures with the first steps to locate the first steps below the outer chines, e. second steps interconnecting the risers and the side portions, substantially parallel to the horizontal plane of the keel centerline and having deadrise angles between 5° and 10°, f. spray strips, to direct the water onto the first steps, located on the lower hull portion and extending from the V-bow rearwardly to a point above the intersection of the planing water line with the boat hull, g. retention strips, to keep the water from spilling off of the first steps, located adjacent the inner chine junctures and comprising short, slightly downwardly angled steps, and h. the outer chine juncture, the inner chine junctures and the juncture of the displacement section and the second steps are substantially parallel to the vertical plane of the keel centerline.

2. A high speed planing boat hull including a transom stern, freeboard side portions extending forwardly from the transom and terminating in a V-bow, and a wide-keeled lower hull portion comprising:

a. a central longitudinally extending keel bottom surface which is of substantially uniform width from the transom forwardly about 60% of the length of the hull and is flat at the transom and extends forwardly at progressively increasing deadrise angles, b. keel sidewalls extending outwardly from the opposite side edges of the keel bottom surface and extending substantially parallel to each other from the transom forwardly about 60% of the length of the hull at deadrise angles greater than those of the keel bottom surface but less than about 45%, c. the combined width of the keel bottom portion and keel sidewalls being about one-half the total width of the lower hull portion, d. a first planing step extending outwardly from the outer side edge of each keel sidewall at a deadrise angle substantially less than the keel sidewall, e. a riser extending upwardly from the outer side edge of each first planing step at a deadrise angle substantially greater than that of the keel sidewalls, f. a second planing step extending outwardly from the upper edge of each riser to the lower edge of the associated freeboard side portion, g. the combined width of the keel bottom portion, keel sidewall portions and first steps being about three-fourths the total width of the lower hull portion and h. retention strips interconnecting the outer edges of the first steps and lower edges of the risers, the retention strips extending laterally outward and slightly downward to direct water onto the first planing steps during high speed planing.

3. The high speed planing boat hull of claim 2 wherein the risers are about three to six inches in height.

4. The high speed planing boat hull of claim 2 wherein each second planing step is about one-half the width of each first planing step.

* * * * *